US010978827B2

(12) United States Patent
Ehrman et al.

(10) Patent No.: US 10,978,827 B2
(45) **Date of Patent: *Apr. 13, 2021**

(54) ON-BOARD DIAGNOSTIC PORT CONNECTOR LOCKING MECHANISM

(71) Applicant: I.D. SYSTEMS, INC., Woodcliff Lake, NJ (US)

(72) Inventors: Michael L. Ehrman, Upper Saddle River, NJ (US); Vladimir Yakhnich, Park Ridge, NJ (US)

(73) Assignee: I.D. SYSTEMS, INC., Woodcliff Lake, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/153,961

(22) Filed: Oct. 8, 2018

(65) Prior Publication Data

US 2019/0044281 A1 Feb. 7, 2019

Related U.S. Application Data

(63) Continuation of application No. 15/433,910, filed on Feb. 15, 2017, now Pat. No. 10,096,940, which is a continuation of application No. 15/040,112, filed on Feb. 10, 2016, now Pat. No. 9,595,789.

(51) Int. Cl.

| | |
|---|---|
| ***H01R 13/629*** | (2006.01) |
| ***H01R 13/627*** | (2006.01) |
| ***H01R 13/639*** | (2006.01) |
| ***H01R 24/68*** | (2011.01) |
| *H01R 107/00* | (2006.01) |

(52) U.S. Cl.

CPC ... *H01R 13/62938* (2013.01); *H01R 13/6271* (2013.01); *H01R 13/62916* (2013.01); *H01R 13/639* (2013.01); *H01R 24/68* (2013.01); *H01R 2107/00* (2013.01)

(58) Field of Classification Search

CPC ..... H01R 13/62938; H01R 13/6271; H01R 13/62916; H01R 13/639; H01R 24/68; H01R 2107/00

USPC ..... 439/460; 174/99 R

See application file for complete search history.

(56) References Cited

U.S. PATENT DOCUMENTS 4,871,323 A * 10/1989 Ohsumi ..... H01R 13/639 439/188
5,154,629 A 10/1992 Carver et al.
5,207,593 A * 5/1993 Bogiel ..... H01R 13/6275 439/345
5,257,944 A * 11/1993 Kennedy ..... H01R 13/639 439/347

(Continued)

*Primary Examiner* — Harshad C Patel

(74) *Attorney, Agent, or Firm* — Troutman Pepper Hamilton Sanders LLP; James E. Schutz; Brennan M. Carmody

(57) ABSTRACT

A diagnostic port connector for a vehicle that includes a locking mechanism is disclosed. The system can comprise a connector body, such as a male OBD-II connector. The connector can include a plurality of connector pins, with the pins capable of passing signals and messages from the vehicle's on board diagnostic system to a device in electrical communication with the connector. The connector can also include a connection retention component. The connection retention component can be configured to maintain a connection between male connectors and female connection ports by interfering with a protruding portion of the female connection port.

14 Claims, 9 Drawing Sheets

(56) References Cited

U.S. PATENT DOCUMENTS 5,370,550 A * 12/1994 Alwine ..... H01R 13/6272 439/352
5,624,271 A * 4/1997 Childs ..... H01R 13/6272 439/352
5,637,009 A * 6/1997 Tsuji ..... H01R 13/639 439/347
5,639,255 A * 6/1997 Muzslay ..... H01R 13/521 439/347
5,755,587 A * 5/1998 Sakai ..... H01R 13/6272 439/352
5,820,409 A * 10/1998 Clark ..... H01R 13/424 439/595
5,823,807 A * 10/1998 Yamasaki ..... H01R 13/62916 439/157
5,823,813 A * 10/1998 Dye ..... H01R 13/6277 439/347
5,928,011 A * 7/1999 Flask ..... H01R 13/4362 439/157
6,056,565 A * 5/2000 Sawayanagi ..... H01R 13/62905 439/157
6,095,831 A * 8/2000 Muramatsu ..... H01R 13/641 439/131
6,196,860 B1 3/2001 Okayasu et al.
6,250,943 B1 * 6/2001 Castle ..... H01R 13/6273 439/352
6,254,407 B1 * 7/2001 Burns ..... H01R 13/62905 439/157
6,491,542 B1 * 12/2002 Zerebilov ..... H01R 13/4226 439/352
6,612,624 B1 9/2003 Segal et al.
6,781,144 B2 * 8/2004 Yonekawa ..... G03B 42/04 250/581
6,818,905 B2 * 11/2004 Yonekawa ..... G03B 42/04 250/484.4
6,942,514 B1 * 9/2005 Cheng ..... H01R 12/7029 439/328
7,104,830 B1 * 9/2006 Diaz ..... H01R 13/6395 439/347
7,549,887 B1 6/2009 Ng et al.
7,731,519 B1 * 6/2010 Swenson, Jr. ..... H01R 13/6271 439/352
8,235,744 B1 * 8/2012 Liptak ..... H01R 13/639 439/352
8,328,562 B1 * 12/2012 Rassoolkhani ..... H01R 11/18 320/104
8,445,780 B1 * 5/2013 Robins ..... H02G 3/14 174/67
8,632,353 B2 * 1/2014 Rassoolkhani ..... H01R 13/639 439/347
9,016,729 B2 * 4/2015 Ishida ..... F16L 37/088 285/308
9,178,312 B2 * 11/2015 Nakajima ..... H01R 13/639
9,595,789 B1 3/2017 Ehrman et al.
9,872,563 B2 * 1/2018 Davis ..... A47B 88/473
10,109,953 B2 * 10/2018 Schmidt ..... H01R 13/639
10,348,034 B1 * 7/2019 Chang ..... H01R 13/6272
2002/0115332 A1 8/2002 Myer et al.
2004/0077205 A1 * 4/2004 Holmes ..... H01R 13/639 439/347
2005/0014412 A1 * 1/2005 Wharton ..... H01R 13/6271 439/352
2005/0136741 A1 * 6/2005 Yoshida ..... F16L 37/088 439/347
2006/0063414 A1 3/2006 Goto
2006/0216991 A1 9/2006 Boutros
2010/0062635 A1 * 3/2010 Jones, Jr. ..... H01R 13/6272 439/370
2012/0135629 A1 5/2012 Montena
2013/0040486 A1 * 2/2013 Kurumizawa ..... H01R 13/639 439/350
2014/0168883 A1 6/2014 Boswell et al.
2014/0295685 A1 10/2014 Wimmer
2015/0197157 A1 * 7/2015 Nakajima ..... B60L 11/1818 439/352
2015/0343913 A1 * 12/2015 Fukai ..... H01R 13/639 74/530
2016/0076288 A1 * 3/2016 Bantle ..... E05F 1/16 49/417
2016/0134048 A1 5/2016 Kato et al.
2017/0018874 A1 * 1/2017 Kida ..... H01R 13/4362
2017/0062984 A1 * 3/2017 Moseke ..... H01R 13/6272

* cited by examiner

ON-BOARD DIAGNOSTIC PORT CONNECTOR LOCKING MECHANISM

CROSS-REFERENCE TO RELATED APPLICATION AND PRIORITY CLAIM

This application is a continuation of U.S. patent application Ser. No. 15/433,910, filed 15 Feb. 2017, entitled "CONNECTOR LOCKING MECHANISM HAVING A ROTATABLE RETENTION COMPONENT," which is a continuation of U.S. patent application Ser. No. 15/040,112, filed 10 Feb. 2016, entitled "CONNECTOR LOCKING MECHANISM HAVING A SLIDING CONNECTION RETENTION COMPONENT," the entire contents and substance of both are incorporated herein by reference in its entirety as if fully set forth below.

BACKGROUND

1. Technical Field

Embodiments of the present invention relate generally to providing an on-board diagnostic port connector in an automobile with a lockable connection, and specifically to a lockable connection that is discreet and easy to operate.

2. Background of Related Art

On-board diagnostic regulations require passenger cars and trucks to be equipped with a standardized connector to provide access to the vehicles diagnostic information. Since 1996, the standard required has been one published in Society of Automotive Engineers paper SAE J1962, known as OBD-II (or OBD2). This standard specifies the signal and message protocols, the pinout of the connector, and the details of the connector itself.

This standard connector is the access point for the diagnostic and operational information about the vehicle. The OBD-II port is crucial in such tasks as checking and clearing diagnostic trouble codes, allowing for governmental vehicle inspection, and driver provided supplemental instrumentation and telematics. These applications generally involve temporary, and voluntary, connections to the car's OBD-II port, commonly referred to as plug and remove.

In the car rental and fleet vehicle industries, there is often a desire to have a device connected to the vehicle's diagnostics. These devices can be hard-wired into the vehicle's electronics, or they can be plugged into the vehicle's OBD-II port. Each of these options has its own advantages and disadvantages.

Devices that are hard-wired into the vehicle's electronics provide the most secure and least intrusive option. Such devices connect directly to the vehicle control unit or are spliced into the wiring harness of the vehicle. If done properly, these connections will be semi-permanent and very reliable. These devices also allow the OBD-II port to be unobstructed and be available for other devices to connect. Furthermore, since they are made in the vehicles wiring, they are rarely visible or otherwise evident without removing dashboard panels or looking in the engine bay. In a rental or fleet situation, the user not being aware of the device can be helpful to prevent tampering or removal.

Though these hard-wired devices offer several advantages, their main drawback is the cost of time and labor associated with their proper installation. Proper installation of a hard-wired device requires a trained technician to first remove interior panels to access the wiring necessary. Once the technician has access to the wiring of the vehicle, great care must be taken to properly tap into the necessary inputs without doing permanent damage to the vehicle. This process can take anywhere from a few hours to a few days per vehicle. Additionally, mistakes made during this installation can cost thousands of dollars to repair. Once the vehicles are no longer to be used in the fleet, uninstalling them to be installed in other fleet vehicles (or to provide for the sale of the decommissioned vehicle) is an equally labor intensive process.

The alternative to such laborious installation procedures is an OBD-II port connected device. These devices have the advantage of taking only minutes or hours to install and secure in the dash area of the vehicle. Similarly, they are easily uninstalled at the end of a vehicle's service time.

Because they are so easily installed and uninstalled, their downside is that they are often disconnected before it is desired by the fleet owner. This could be from vibrations gradually loosening the connection, an operator accidentally knocking the plug out, or a driver intentionally unplugging a device. The standard for OBD-II requires that the port be located within reach of the steering wheel, which typically results in the port being located in or around the foot well of a passenger vehicle. As such, a driver may accidentally contact the plug, loosening or disconnecting the device from the vehicle. Furthermore, potential operators may seek to intentionally remove the devices, either to prevent the collection of vehicle data, or to steal the device.

What is needed, therefore, is an OBD-II compliant connector that is easy for a technician to install and uninstall, but difficult for an operator to knock loose or remove without permission. It is to such systems and methods that embodiments of the present invention are primarily directed.

BRIEF SUMMARY

Embodiments of the present invention relate generally to an OBD-II connector that provides a locking mechanism, and specifically to a connector including a covert locking mechanism to reduce the cost of installation while providing security. Embodiments of the present invention can include a diagnostic port connector for a vehicle. A diagnostic port connector according to the present disclosure can include a connector body, configured to mate with a female port associated with a vehicle and a plurality of connector pins. The connector pins can be configured to pass at least one signal or message from an on board diagnostic system of the vehicle to a device in electrical communication with the connector. In some embodiments, a connection retention component can be a part of the connector body, and can be configured to prevent unintentional loss of connection between the connector and the female port.

In some embodiments, the connection retention component is movable from an unlocked position to a locked position. The connection retention component can be positioned to physically interfere with a protrusion from an upper surface of the female port if the connector body is pulled away from the female port while in the connection retention component is in the locked position. In some embodiments, the connection retention component moves from the unlocked to the locked position by sliding. Some embodiments can have a connection retention component having a central interference portion located adjacent to a non-interfering portion, and some embodiments can have a single non-interfering portion located closer to a first end of the connection retention component than a second end of the connection retention component. Some embodiments according to the present disclosure can have a connection retention component is configured to slide from the unlocked position into the locked position by moving closer to the upper surface of the female port.

In some embodiments, a user may be able to move the connection retention component from the unlocked position to the locked position and from the locked position to the unlocked position using only one hand. Additionally, a user may be able to move the connection retention component from the unlocked position to the locked position and from the locked position to the unlocked position without the use of any visual indicators.

In some embodiments, the connection retention component moves from the unlocked to the locked position by rotating. The connection retention component can include a tab located at a first end of the connection retention component, an interference portion located at a second end of the connection retention component, and the tab is accessible to a user during locking or unlocking. The connector can also have a connection retention component that moves from the unlocked to the locked position by pressing the connector body towards the female port.

Embodiments of the present invention also relate generally to a method of securing a diagnostic port connector. Embodiments of a method according to the present disclosure can include the steps of providing a male connector, engaging the male connector with a female port associated with the vehicle, moving a connection retention component from an unlocked position to a locked position to prevent unintentional loss of connection between the connector and the female port. The connector can include a connector body and a plurality of connector pins, with the connector pins configured to pass at least one signal or message from an on board diagnostic system of a vehicle to a device in electrical communication with the connector. When the male connector engages the female port, the connector pins can form an electrical connection between the male connector and the vehicle.

The connection retention component can be configured to physically interfere with a protrusion from an upper surface of the female OBD-II port if the connector body is pulled away from the female OBD-II port while in the connection retention component is in the locked position. In some embodiments, the step of moving a connection retention component from an unlocked position to a locked position further comprises sliding the connection retention component laterally. Sliding the connection retention component laterally can move an interference portion into the locked position.

In some embodiments, the step of moving a connection retention component from an unlocked position to a locked position can include rotating the connection retention component by pressing on a tab at a first end to move an interference portion at a second end into the locked position.

These and other objects, features and advantages of the present invention will become more apparent upon reading the following specification in conjunction with the accompanying drawing figures.

DETAILED DESCRIPTION

Embodiments of the present invention relate generally to an OBD-II connector that provides a locking mechanism, and specifically to a connector including a covert locking mechanism to reduce the cost of installation while providing security. Embodiments of the present invention provide improved device security, easier installation and removal, and convenience, while reducing the likelihood of accidental or intentional disconnection. Embodiments of the present invention can utilize one of several versions of a locking mechanism, but each using existing features of the standard female OBD-II connector to maintain the connection to the vehicle. In some embodiments, the system can provide an LED indicator of a proper installation, for example.

To simplify and clarify explanation, the connector is described below as a connector for attaching a component to a fleet or rental car on a commercial level. One skilled in the art will recognize, however, that the invention is not so limited. The system can also be deployed for other applications such as, for example, parental monitoring, insurance adjustments, or any other application where secure OBD-II connections are desirable.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

As mentioned above, a problem with current vehicle diagnostic connections is that they either require a great deal of time and skill to install or uninstall, or that they use standard OBD-II connectors that may come loose intentionally or unintentionally. In conventional hard-wired applications, for example, a technician must exercise great care and time to safely splice wires into a vehicle's wiring harness. Current OBD-II plug and remove systems reduce installation time, but these connections are unreliable and can come loose due to vibration, gravity, incidental contact, or intentional unplugging. What is needed, therefore, is a connection that is more reliable than standard OBD-II connectors, but that is easily installed and uninstalled by a technician trained in the connector. It is to such a connection that embodiments of the present disclosure are primarily directed.

Figure 1:
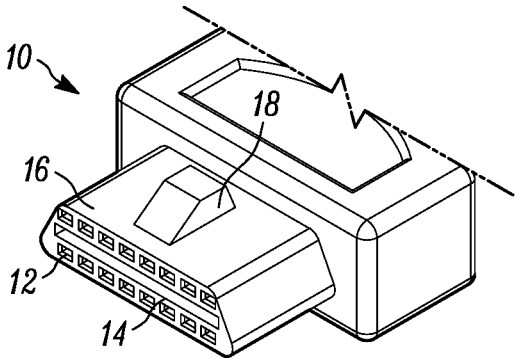
PRIOR ART FIG. 1
FIG. 1 depicts a female OBD-II port according to the prior art standard.

FIG. 1 illustrates an embodiment of a female OBD-II connection port 10 in accordance with SAE J1962. This standard connector has 16 pin receptacles 12 arranged in two rows of 8. The rows are spaced about 5-10 mm apart, and within each row, the receptacles are spaced about 4 mm apart. The face 14 of female OBD-II connection port 10 has a profile that is roughly an isosceles trapezoid in shape. The longer side of the trapezoid is about 37.55 mm, and the shorter side is about 31.5 mm. Projecting from upper surface 16 is ramped protrusion 18. Ramped protrusion 18 is the only feature permitted by SAE J1962 that would allow any retention devices to be used for maintaining a connection.

Figure 2A:
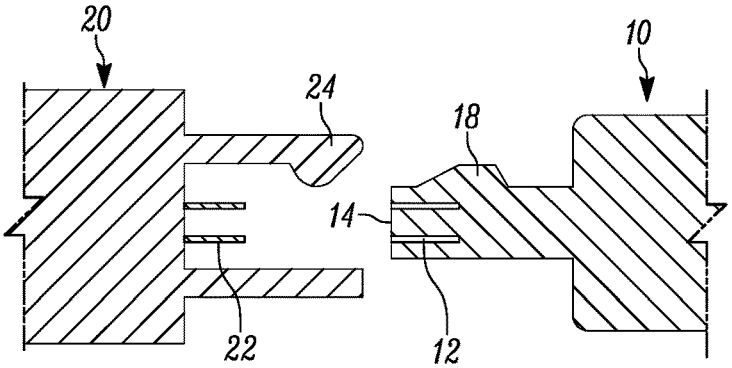
FIG. 2A PRIOR ART
FIG. 2A illustrates a prior art male connector preparing to connect to the female connector of FIG. 1.
Figure 2B:
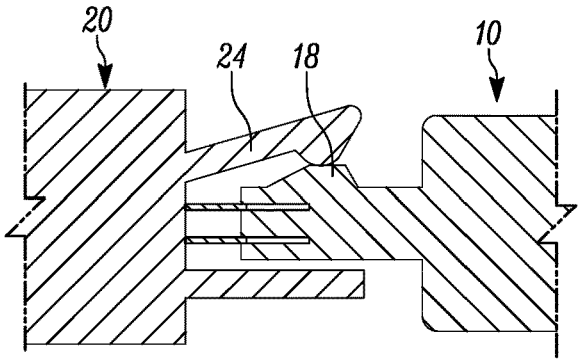
FIG. 2B PRIOR ART
FIG. 2B illustrates a prior art male connector in the process of connecting to the female connector of FIG. 1.
Figure 2C:
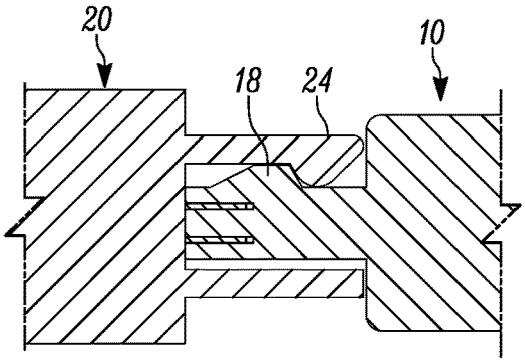
FIG. 2C PRIOR ART
FIG. 2C illustrates a prior art male connector connected to the female connector of FIG. 1.

An example of the prior art manner of engaging female port 10 in FIG. 1 is depicted in FIGS. 2A, 2B, and 2C. Male OBD-II connector 20 includes pins 22. The SAE specification refers to this retention device as a spring clip, and notes that it is an optional feature to the specification. As FIG. 2B illustrates, spring clip 24 is able to follow protrusion 18 during the connection process between female port 10 and male connector 20, and provide some resistance to disconnection. FIG. 2C shows how spring clip 24 is positioned behind protrusion 18 in its fully engaged state; however its flexibility means that clip 24 does not provide interference with protrusion 18 if connector 20 is pulled away from port 10. This optional feature is insufficient to provide security against an accidental or intentional pull on the cable or connector, nor is it designed to prevent such strain. Furthermore, when left in hot environments (such as a locked car) for prolonged periods, and cycled through many connections and disconnections, spring clip 24 can become fatigued. When the resilience of spring clip 24 is lost, its ability to provide resistance to disconnection is also lost.

Figure 3:
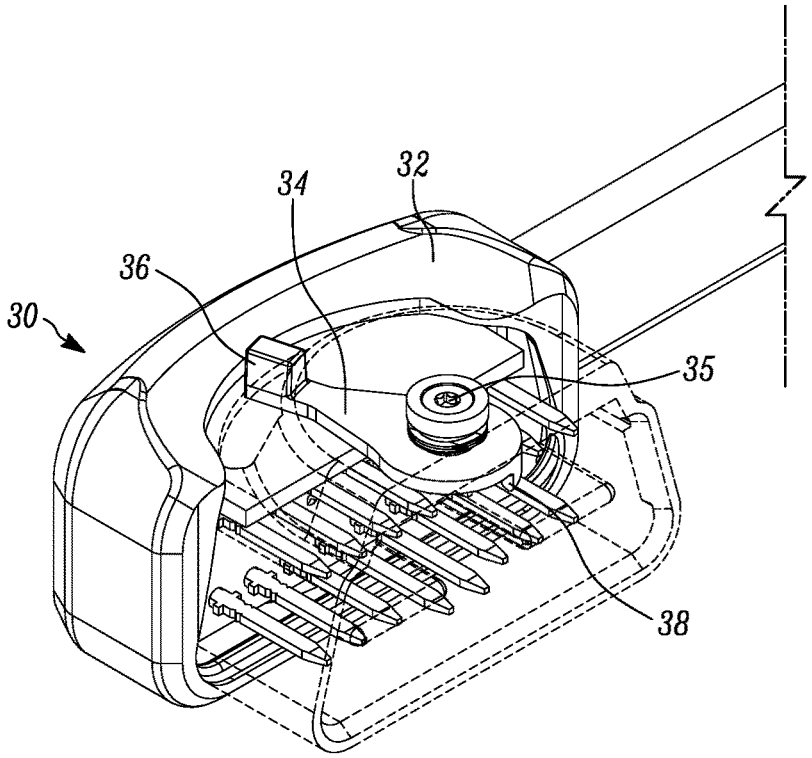
FIG. 3 depicts a male connector in the unlocked position, in accordance with some embodiments of the present invention.

FIG. 3 illustrates an embodiment according to the present disclosure, and is designed to address the shortcomings of the prior art as discussed above. Connector 30 is illustrated in an unlocked state. Connector body 32 is sized and shaped, according to the SAE standard, to mate with the female OBD-II port. Connector body 32 can have an outward face that faces away from the female OBD-II port in a connected state. Connector 30 is also provided with connection retention component 34, which is able to be rotated about axle 35 from the unlocked state depicted in FIG. 3, to the locked state in FIG. 4.

Figure 4:
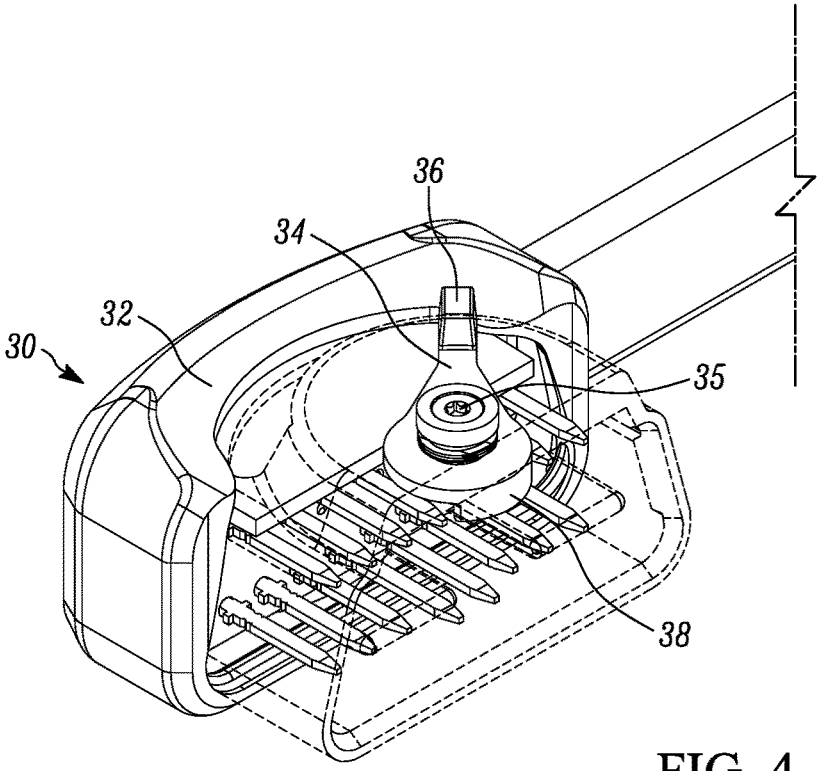
FIG. 4 depicts the male connector of FIG. 3 in the locked position, in accordance with some embodiments of the present invention.

During installation, the trained technician, being aware of the rotating lock, would press connector body 32 into the vehicle's female port, and then rotate connection retention component 34 by manipulating tab 36. Tab 36 may be recessed into connector body 32, or tab 36 may slightly protrude. The locked state of connector 30 is illustrated in FIG. 4. In the locked position, interference portion 38 can physically interfere with the protrusion (present on all female OBD-II ports) if an attempt is made to disconnect connector 30 from the female port.

Connection retention component 34 can be substantially rigid, such that it does not deform or bend when connector 30 is pulled. Contrary to prior art mechanisms, such as those depicted in FIGS. 2A-2C, interference portion 38 does not follow the protrusion on the female connector during the connection process between female port and male connector 30. In the unlocked state, connection retention component 34 can be positioned such that interference portion 38 passes to one side of the protrusion of the female connector as the connector and port are mated. Once the female and male components are fully engaged, connection retention component 34 can be manipulated to move interference portion 38 behind the protrusion on the female port. In this locked state, connector 30 cannot be unmated from the female port without the protrusion on the female port abutting interference portion 38. In order to disconnect connector 30, connection retention component 34 must be manipulated to the unlocked position.

A trained technician would be able to locate and manipulate tab 36, while a non-trained user would be unlikely to notice or know how to move tab 36 in order to unlock and disconnect connector 30. As previously mentioned, and in accordance with the OBD-II regulations, vehicle diagnostic ports are often located in or around the foot well of the vehicle, and rarely in a driver's line of sight during normal vehicle operation. Unless a person knows what to look for, and how to manipulate it, it is unlikely that the driver of a rental vehicle, for example, would be able to find and manipulate tab 36 to move interference portion 38 from its locked position. Connector 30 is unable to be disconnected, intentionally or otherwise, while interference portion 38 is in its locked position abutting the protrusion from the upper surface of the female port. In this important way, connector 30 is more secure than connectors present in the prior art.

Figure 5:
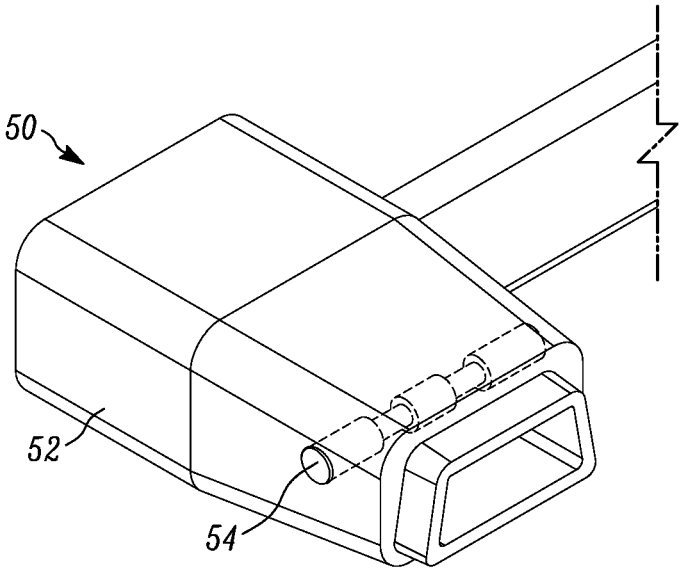
FIG. 5 depicts a male connector in the unlocked position, in accordance with some embodiments of the present invention.
Figure 6A:
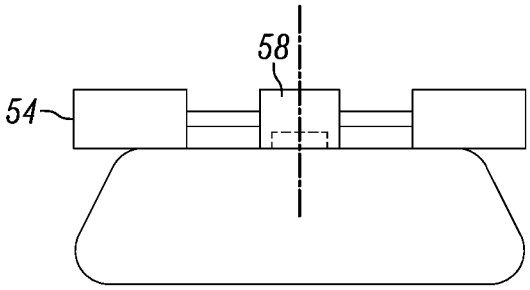
FIG. 6A illustrates the slider of the male connector of FIG. 5 in the locked position.
Figure 6B:
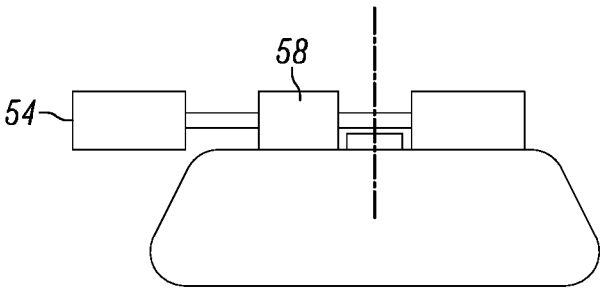
FIG. 6B illustrates the slider of the male connector of FIG. 5 in the unlocked position, in accordance with some embodiments of the present invention.

An embodiment according to the present disclosure is illustrated in an unlocked state in FIG. 5. In this embodiment, connector 50 is provided with connection retention component 54. Connection retention component 54 is capable of being slid between unlocked and locked states. In FIGS. 6A and 6B, the locked and unlocked positions of connection retention component 54 of connector 50 are illustrated with respect to the centerline of the female port (illustrated in dashed lines).

During installation, the installer would press connector body 52 into the vehicle's female port, and then slide connection retention component 54 such that it would be substantially centered in connector body 52. In this locked position, interference portion 58 would physically interfere with the protrusion on the female port if an attempt is made to disconnect connector 50 from the female port.

Connection retention component 54 can be slidably engaged with a portion of connector body 52 such that it is able to only move axially in one direction. Connection retention component 54 may have an unlocked position; wherein interference portion 58 does not interfere with the protrusion on the female port when connector 50 is mated with a female port. In some embodiments, connection retention component 54 may have two unlocked positions, with one being when interference portion 58 is on one side of a protrusion of a female port, and another being when interference portion of connection retention component 54 slides past the centerline of the female port to the other side of the protrusion. Connection retention component 54 may include end surfaces designed to be pushed or pressed by a person's finger to position connection retention component 54 and specifically interference portion 58 into or out of the path of the protrusion on the female port.

When interference portion 58 is substantially aligned with the centerline of the female port after connector 50 has been connected thereto, connector 50 cannot be unmated from the female port without the protrusion on the female port abutting interference portion 58. Because connection retention component 54 is constrained to move linearly in a direction parallel to the upper surface of the female port, interference portion 58 is unable to follow the slope of the protrusion from the female port. As such, the only way to allow connector 50 to disconnect is to manipulate connection retention component 54 into an unlocked position.

While a trained technician is able to locate and manipulate connection retention component 54, a non-trained user would be unlikely to notice or know how to move connection retention component 54 in order to unlock and disconnect connector 50. If a vehicle operator were to look at connector 50 from the vehicle cabin, connection retention component 54 would not be visible. In the locked state, connection retention component 54 may be substantially flush with connector body 52, making it very difficult to see. Absent prior knowledge of the existence of a locking mechanism, a driver would have a difficult time removing connector 50, intentionally or otherwise.

Figure 7:
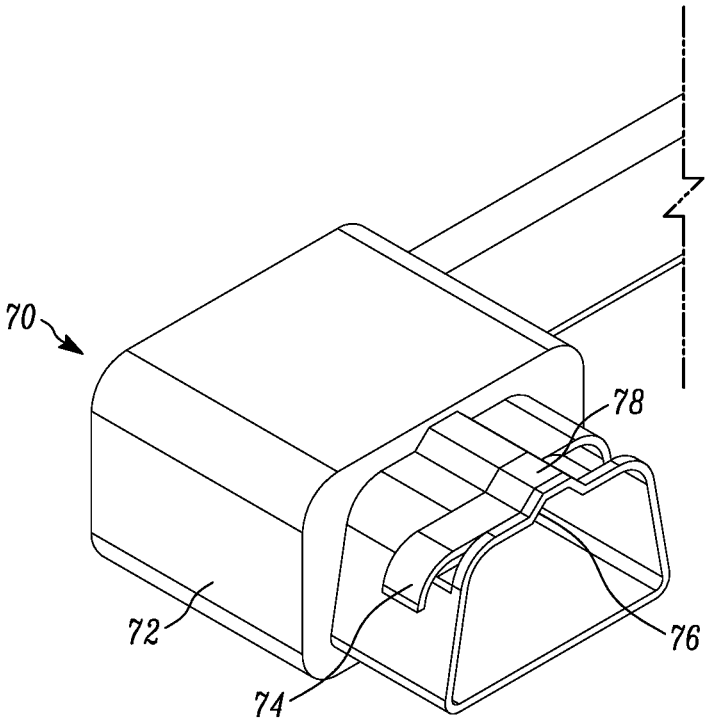
FIG. 7 depicts a male connector in the unlocked position, in accordance with some embodiments of the present invention.
Figure 8:
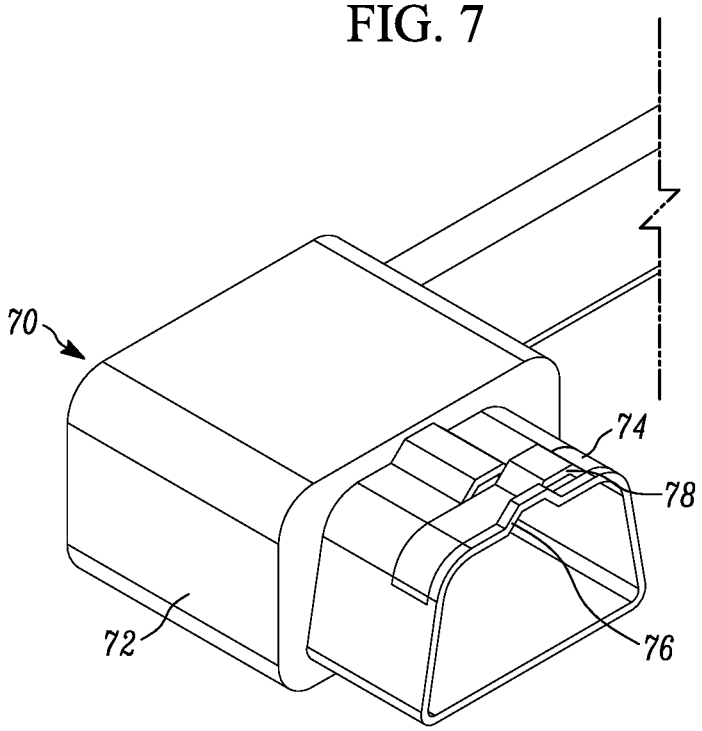
FIG. 8 depicts the male connector of FIG. 7 in the locked position, in accordance with some embodiments of the present invention.

FIGS. 7 and 8 illustrate connector 70, in accordance with an embodiment of the present disclosure. Connector 70 is provided with connection retention component 74. Connection retention component 74 is capable of being slid between unlocked and locked states, as can be seen in FIG. 7 (unlocked) and FIG. 8 (locked).

Similar to connector 50 above, connection retention component 74 can be slidably engaged with a portion of connector body 72 such that it is able to only move axially in one direction. Connection retention component 74 may have an unlocked position; wherein groove 78 aligns with channel 76, thereby allowing the protrusion on the female port to pass. Once connector 70 engaged the female port, connection retention component 74 can be manipulated so that groove 78 no longer aligns with channel 76, and the protrusion can no longer pass.

During installation, the installer would press connector body 72 into the vehicle's female port, while groove 78 of connection retention component 74 is aligned with channel 76 of connector body 72. To lock, the installer will then slide connection retention component 74 such that it would be substantially flush with connector body 72 at the outer edges. In this locked position, groove 78 is no longer aligned with channel 76, and therefore connection retention component 74 would physically interfere with the protrusion on the female port if an attempt is made to disconnect connector 70 from the female port.

As with the previously discussed embodiments, a non-trained user would be unlikely to notice or know how to move connection retention component 74 in order to unlock and disconnect connector 70. If a vehicle operator were to look at connector 70 from the vehicle cabin, connection retention component 74 would not be visible, and without sliding connection retention component 74, connector 70 will not be able to fall or be pulled loose.

Figure 9:
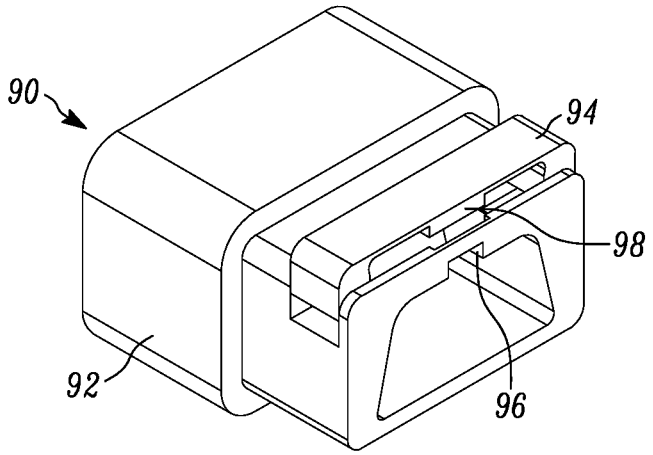
FIG. 9 depicts a male connector in the unlocked position, in accordance with some embodiments of the present invention.
Figure 10:
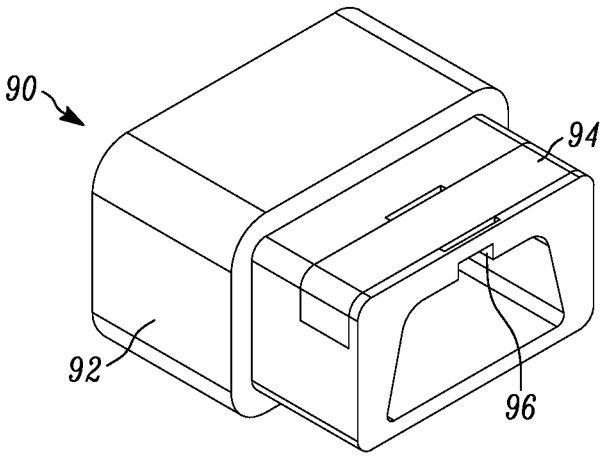
FIG. 10 depicts the male connector of FIG. 9 in the locked position, in accordance with some embodiments of the present invention.

Another embodiment according to the present disclosure is illustrated in an unlocked state in FIG. 9. Connector 90 has a similar connection retention mechanism as connector 70. In some embodiments, connection retention mechanism 94 can be configured to slide laterally, however as depicted in FIGS. 9 and 10, connection retention mechanism 94 can be configured to slide towards and away from the upper surface of the female port to lock and unlock. In the unlocked state, channel 96 allows the protrusion on the female port to clear connector body 92. When locked however, interference portion 98 of connection retention mechanism 94 abuts the upper surface of the female port and the protrusion there from, and prevents connector 90 from disengaging.

As FIG. 10 illustrates, in the locked position, connection retention mechanism 94 may be substantially flush with connector body 92, making it potentially very difficult to notice the locking mechanism exists. Absent prior knowledge of the workings of the connector, disengaging it from the vehicle will be particularly difficult.

Figure 11:
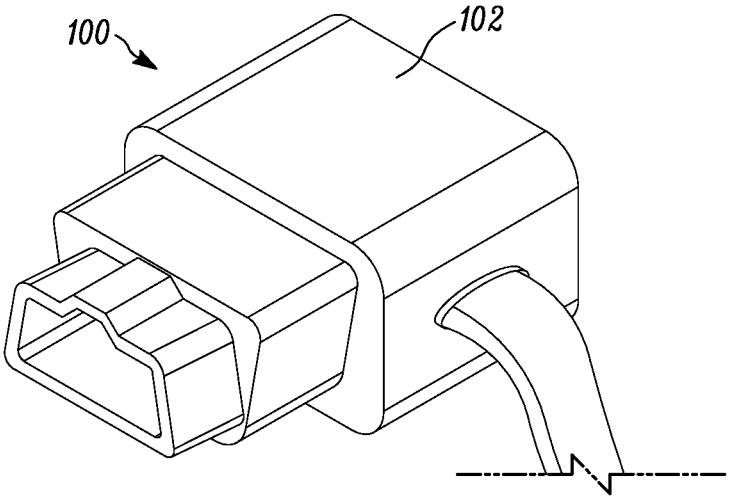
FIG. 11 depicts a male connector featuring a push in to unlock feature, in accordance with some embodiments of the present invention.

Connector 100, illustrated in FIG. 11, is designed to operate using a push-latch mechanism. The process of connecting connector 100 to a female port would involve simply pushing the connector body 102 into place. When it comes time to disconnect, pulling on connector 100 would not release it from the vehicle. The trained technician would know to push connector 100 forward towards the female port to release the latch, and then allow for disconnection. Accidental or vibration-related disconnections would be unlikely due to the connector needing to be pushed not pulled. Further, as with other embodiments in accordance with the present disclosure, those unfamiliar with the workings of connector 100 would be unlikely to figure them out via a visual inspection. Because of this, connector 100 would take almost no additional time or effort to install or uninstall, but would offer a great deal more security for devices installed in fleet or rental vehicles, for example.

Figure 12A:
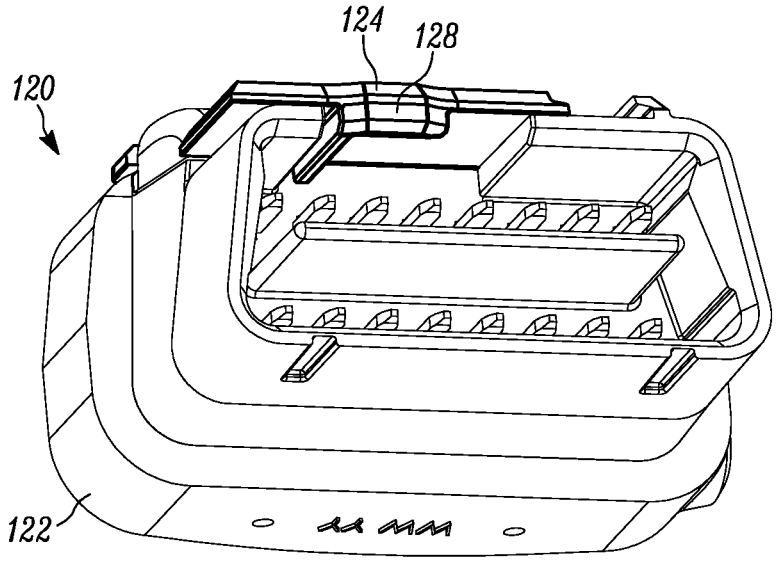
FIG. 12A depicts a perspective view from the underside of a male connector in the unlocked position, in accordance with some embodiments of the present invention.
Figure 12B:
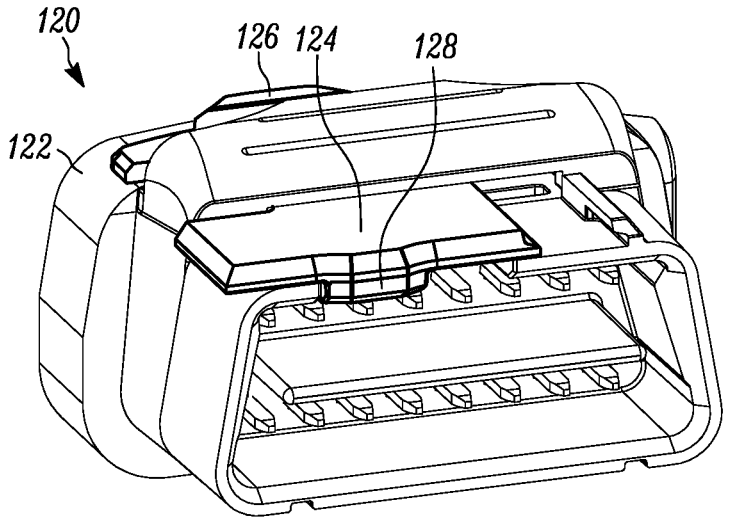
FIG. 12B depicts a perspective view of a male connector in the unlocked position, in accordance with some embodiments of the present invention.
Figure 13A:
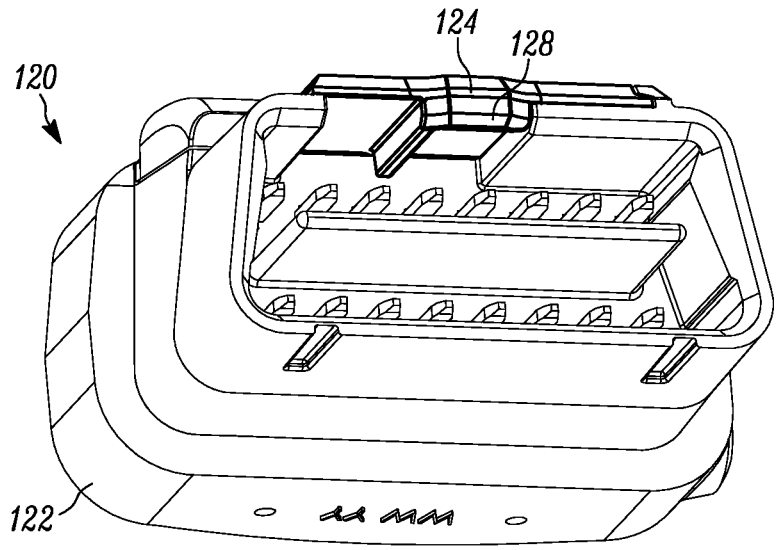
FIG. 13A depicts a perspective view from the underside of the male connector of FIGS. 12A and 12B in the locked position, in accordance with some embodiments of the present invention.
Figure 13B:
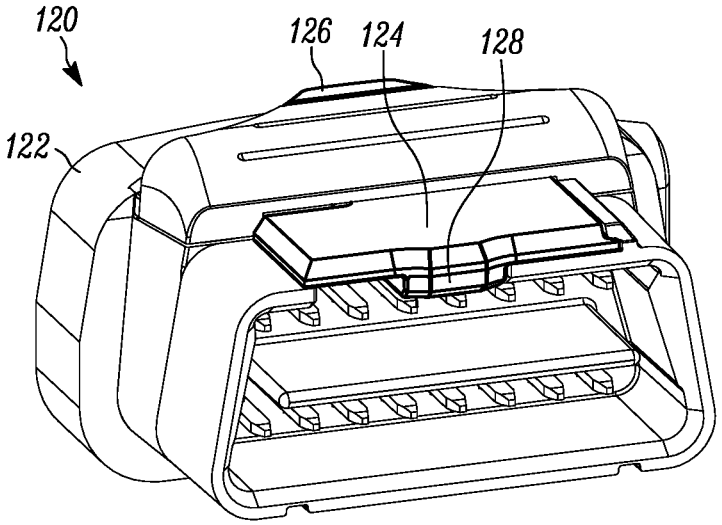
FIG. 13B depicts a perspective view of a male connector in the unlocked position, in accordance with some embodiments of the present invention.

An embodiment according to the present disclosure is illustrated in an unlocked state in FIGS. 12A and 12B. FIG. 12A shows the inner side of connector 120, and FIG. 12B shows a perspective view of the top side of connector 120. In this embodiment, connector 120 is provided with connection retention component 124 in communication with connector body 122. Connection retention component 124 is capable of being slid between unlocked and locked states. In FIGS. 12A and 12B, the unlocked position of connection retention component 124 of connector 120 is illustrated, with a portion of connection retention component 124 abutting a surface of connector body 122 to serve as a stop. In FIGS. 13A and 13B, the locked position of connection retention component is illustrated, wherein another portion of connection retention component abuts another surface on an opposite side of connector body 122.

During installation, the installer would press connector body 122 into the vehicle's female port, and then slide connection retention component 124 such that it would be substantially centered in connector body 122. In this locked position, interference portion 128 would physically interfere with the protrusion on the female port if an attempt is made to disconnect connector 120 from the female port.

Connection retention component 124 can be slidably engaged with a portion of connector body 122 such that it is able to only move axially in one direction. Connection retention component 124 may have an unlocked position; wherein interference portion 128 does not interfere with the protrusion on the female port when connector 120 is mated with a female port. Connection retention component 124 may include tab 126 designed to be pushed or pressed by a person's finger to position connection retention component 124 and specifically interference portion 128 into or out of the path of the protrusion on the female port.

When interference portion 128 is substantially aligned with the centerline of the female port after connector 120 has been connected thereto, connector 120 cannot be unmated from the female port without the protrusion on the female port abutting interference portion 128. Because connection retention component 124 is constrained to move linearly in a direction parallel to the upper surface of the female port, interference portion 128 is unable to follow the slope of the protrusion from the female port. As such, the only way to allow connector 120 to disconnect is to manipulate connection retention component 124 into an unlocked position.

While a trained technician is able to locate and manipulate connection retention component 124, a non-trained user would be unlikely to notice or know how to move connection retention component 124 in order to unlock and disconnect connector 120. If a vehicle operator were to look at connector 120 from the vehicle cabin, connection retention component 124 would not be visible. In the locked state, connection retention component 124 may be substantially flush with a portion of connector body 122, making it very difficult to see. Absent prior knowledge of the existence of a locking mechanism, a driver would have a difficult time removing connector 120, intentionally or otherwise.

Regardless of the specific connection retention mechanism arrangement selected, several elements may be significant to the functionality and practicality of the connector. For example, it may be preferable to provide a connection retention mechanism that is capable of being operated with one hand during installation. Due to the location of the female OBD-II port, an installer may only have sufficient room to reach in with one hand. In such applications, the hand holding the connector should be capable of both pushing the connector into the female OBD-II port as well as manipulating the connection retention mechanism into the locked or unlocked positions. Similarly, the location of the female OBD-II port may not provide a direct line of sight to the area immediately surrounding the port, or even to the port itself. In such situations, it may be preferred to configure the connection retention mechanism to be able to be located and operated without the use of visual indicia.

Further, a goal of the connector design may be to provide universal, or nearly universal, applicability to different vehicles. In these instances, the connector may be designed to be low profile near the mating location. This may include shaping the connector to be narrower or thinner in the areas adjacent to the female OBD-II port to avoid interfering with other components that may be situated nearby. This may also include reducing the overall length of the connector (in a direction parallel to the connector pins) in order to minimize the likelihood that the connector will protrude too far into the passenger compartment or foot well. Should the connector protrude too far, a driver may not only be alerted to its presence, but may also contact the connector with their knee or foot during normal driving activities.

While several possible embodiments are disclosed above, embodiments of the present invention are not so limited. For instance, while several possible covert locking mechanisms have been disclosed, other suitable arrangements for preventing connection disengagement could be selected without departing from the spirit of the invention. In addition, the location and configuration used for various features of embodiments of the present invention can be varied according to a particular application or need as required. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

We claim:

1. A diagnostic port connector for a vehicle comprising:

a connector body, configured to mate with a female port associated with the vehicle;

a plurality of connector pins, the connector pins configured to pass at least one signal or message from an on board diagnostic system of the vehicle to a device in electrical communication with the connector;

a connection retention component, configured to automatically move to a locked position to prevent unintentional loss of connection between the connector and the female port upon engagement of the connector with the female port;

wherein the connection retention component is configured to physically interfere with a protrusion from an upper surface of the female port if the connector body is pulled away from the female port while the connection retention component is in the locked position; and wherein the connection retention component moves from the locked position to an unlocked position by sliding the connector body towards the female port while the connector is engaged with the female port.

2. The connector of claim 1, wherein the connection retention component further comprises an interference portion located adjacent to a non-interfering portion.

3. The connector of claim 1, wherein a user is capable of moving the connection retention component from the locked position to the unlocked position using only one hand.

4. The connector of claim 1, wherein a user is capable of moving the connection retention component from the locked position to the unlocked position without any external visual indicators of the movement from the locked position to the unlocked position.

5. The connector of claim 1, wherein the connection retention component comprises a push-latch mechanism.

6. A male OBD-II connector for connecting to a vehicle comprising:

a connector body, configured to mate with a female OBD-II port associated with the vehicle;

a plurality of connector pins, the connector pins configured to pass at least one signal or message from an on board diagnostic system of the vehicle to a device in electrical communication with the connector;

a connection retention component, configured to automatically move to a locked position to prevent unintentional loss of connection between the connector and the female OBD-II port upon insertion of the connector into the female OBD-II port;

wherein the connection retention component is configured to physically interfere with a protrusion from an upper surface of the female OBD-II port if the connector body is pulled away from the female OBD-II port while the connection retention component is in the locked position; and wherein the connection retention component moves from the locked position to an unlocked position by sliding the connector body towards the female OBD-II port while the connector is engaged with the female OBD-II port.

7. The male OBD-II connector of claim 6, wherein the connection retention component further comprises an interference portion located adjacent to a non-interfering portion.

8. The male OBD-II connector of claim 6, wherein a user is capable of moving the connection retention component from the locked position to the unlocked position using only one hand.

9. The male OBD-II connector of claim 6, wherein a user is capable of moving the connection retention component from the locked position to the unlocked position without any external visual indicators of the movement from the locked position to the unlocked position.

10. The male OBD-II connector of claim 6, wherein the connection retention component comprises a push-latch mechanism.

11. A method of securing a diagnostic port connector, the method comprising:

providing a male connector comprising a connector body and a plurality of connector pins, the connector pins configured to pass at least one signal or message from an on board diagnostic system of a vehicle to a device in electrical communication with the connector;

engaging the male connector with a female port associated with the vehicle such that the connector pins form an electrical connection between the male connector and the vehicle, a connection retention component automatically moving to a locked position to prevent unintentional loss of connection between the connector and the female port upon engagement of the male connector with the female port;

wherein the connection retention component is configured to physically interfere with a protrusion from an upper surface of the female port if the connector body is pulled away from the female port while the connection retention component is in the locked position; and wherein moving the connection retention component from the locked position to an unlocked position is accomplished by sliding the connector body toward the female port linearly while the male connector is engaged with the female port; and wherein a user is capable of moving the connection retention component from the locked position to the unlocked position without any external visual indicators of the movement from the locked position to the unlocked position.

12. The method of claim 11, wherein moving the connection retention component from the locked position to the unlocked position moves an interference portion towards the protrusion from the upper surface of the female port.

13. The method of claim 11, wherein a user is capable of moving the connection retention component from the locked position to the unlocked position using only one hand.

14. The method of claim 11, wherein the connection retention component comprises a push-latch mechanism.

* * * * *